US005893236A

United States Patent [19]

Krbec et al.

[11] Patent Number: 5,893,236

[45] Date of Patent: Apr. 13, 1999

[54] POWER OPERATOR FOR SLIDING PLUG DOORS

[75] Inventors: Marianne L. Krbec, Elmhurst; Robert L. Oakley, Palos Heights, both of Ill.

[73] Assignee: Westinghouse Air Brake Company, Wilmerding, Pa.

[21] Appl. No.: 08/855,418

[22] Filed: May 13, 1997

[51] Int. Cl.[6] ..... E05C 7/06

[52] U.S. Cl. ..... 49/118; 49/210; 49/211

[58] Field of Search ..... 49/116, 117, 118, 49/208, 209, 210, 211

[56] References Cited

U.S. PATENT DOCUMENTS

| | | | |
|---|---|---|---|
| 1,411,039 | 3/1922 | Lacey | 49/118 |
| 3,261,128 | 7/1966 | Slopa et al. | 49/118 X |
| 4,091,570 | 5/1978 | Favrel | 49/118 |
| 4,698,938 | 10/1987 | Huber | 49/118 X |
| 5,142,823 | 9/1992 | Brandenburg et al. . | |
| 5,483,769 | 1/1996 | Zweili . | |

FOREIGN PATENT DOCUMENTS

| | | | |
|---|---|---|---|
| 0492 743 A1 | 7/1992 | European Pat. Off. . | |
| 3023647 | 11/1993 | WIPO | 49/118 |

OTHER PUBLICATIONS

Transferio Tebel; Product Info No. R.M. 02.212D Apr. 12, 1994.

*Primary Examiner*—Jerry Redman
*Attorney, Agent, or Firm*—James Ray & Associates

[57] ABSTRACT

A powered operator for sliding plug doors mounted on a movable carriage mounted overhead of an opening in the side wall of a transit vehicle, said doors including a single electric prime mover driving dual helical drives, each operating a door hanger attached to a single door panel over and away from said opening and for moving said carriage out of said side wall pocket. Door hangers used provide controlled deflection of door panels when in a fully open position. Drive linkages lock door panels when in a plugged position. The operator also provides guidance for the lower edge of said door panels during plugging and unplugging operations. Control elements and a central controller provides sequential door panel movement into and out of a pocket in the transit car side wall.

8 Claims, 8 Drawing Sheets

2

(OPEN)
9
24
20
8
14
12
27
4
10
15
16
5
3

2

(SEMI-CLOSED)
24
14
9
27
15
16
10
4

2

(FULLY CLOSED)
9
15

(WITH COVER)

4
14
20
21
31
35
38
39
45
48
50
52
A
A1
A2
11
24
OC 4
14
24
27
31
39
45
48
11
13
28
12

POWER OPERATOR FOR SLIDING PLUG DOORS

CROSS REFERENCE TO RELATED APPLICATIONS

Not applicable

BACKGROUND OF THE INVENTION

This invention relates generally to power operated doors for mass transit vehicles and more particularly concerns door operators of the type wherein big-parting door panels are moved into and out of a pocket opening in the side wall of a transit vehicle and over and away from said opening to permit passenger travel into and out of said vehicle. Generally speaking, plug doors are used on vehicles where, in a closed and plugged position, the door panels are positioned in a pocket opening in the vehicle side wall, thereby becoming in a closed and plugged position, essentially part of the side wall. This type of construction minimizes interference with the car structure and presents an uninterrupted car body surface.

Plug doors have been in use for a substantial period of time. Operators of this kind are disclosed in U.S. Pat. Nos. 5,142,823 and 5,483,769. In addition, a certain plug door operator bearing the trade name ESCO-DOOR and marketed by Transferia Tebel also provides plug door operation.

Although the above mentioned operators are reasonably effective, certain shortcomings have been encountered in use, particularly in respect to complicated linkages between the electric prime mover and operator carriage, resulting in reduced reliability. Other shortcomings of these earlier designs include spring actuated over center locking of the plug and plug carriage, use of telescoping hangers incorporating poorly controlled door motion for individual door panels, and lever actuated plugging/unplugging links operated by extended motor shafts.

The invention disclosed herein overcomes the above-mentioned difficulties through the use of an integral carriage containing all operator elements. The plugging and unplugging movement is obtained through the use of a single shaft drive motor mounted on the carriage providing both panel door motion and plug/unplug motion through the use of planetary gearing.

Also, guidance for the door panel lower edges is provided by a lever operated vertical shaft actuated by the carriage during plugging and unplugging movements into and out of the car door pocket.

Therefore, an object of this invention is to provide a powered door operator for bi-parting door panels including plugging and unplugging operations wherein the entire drive system is mounted on a carriage movable into and out of the car door pocket.

It is a further object of this invention to provide a powered plug door operator for bi-parting doors wherein a combination of planetary and straight gearing provides door panel movement over and away from an opening in the car side wall and door panel plugging into a car side wall door pocket.

It is a further object of the invention to provide a plug door operator wherein in the door closed and plugged position doors are held in the door pocket through over-center linkage geometry.

It is yet an additional object of the invention to provide a plug door operator wherein individual bi-parting door panel hangers are of a simple non-telescoping design.

SUMMARY OF THE INVENTION

The plug door operator disclosed herein utilizes a single carriage containing all elements of the drive. Mounted on a base plate overhead of an opening in a car door side wall, the carriage of the operator disclosed herein is moved into and out of a pocket formed in the car side wall through the use of a single motor with multiple gearing. Door panel movement is provided by dual counter-rotating helical drives, each gear driven from the single shaft electric prime mover. A single hanger mounted on individual transverse slides provides controlled deflection of the panel hanger combination. The plugging motion is also provided from the single shaft prime mover through the use of the combination of curved track and epicyclic planetary gearing operating a plug/unplug shaft. Linkage utilized provides an over-center lock in a plugged position.

BRIEF DESCRIPTION OF THE DRAWINGS

Other objects and advantages will become apparent upon reading the following detailed description and upon reference to the drawings, in which.

DETAILED DESCRIPTION OF OPERATION

Figure 1:
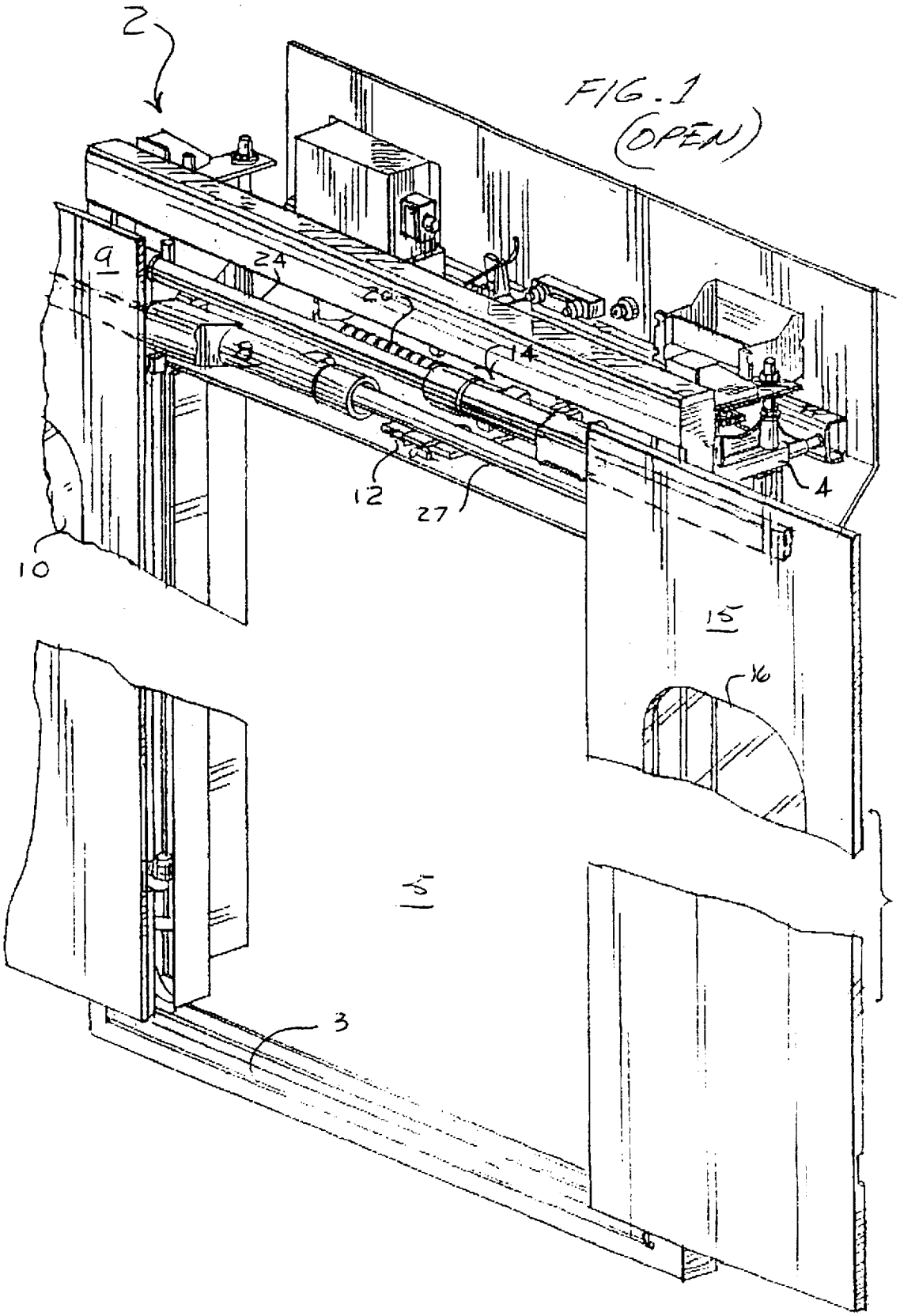
FIG. 1 shows the operator of the invention attached to bi-parting doors in an open condition, particularly showing the juxta positioning of the non-telescoping hangers.
Figure 2:
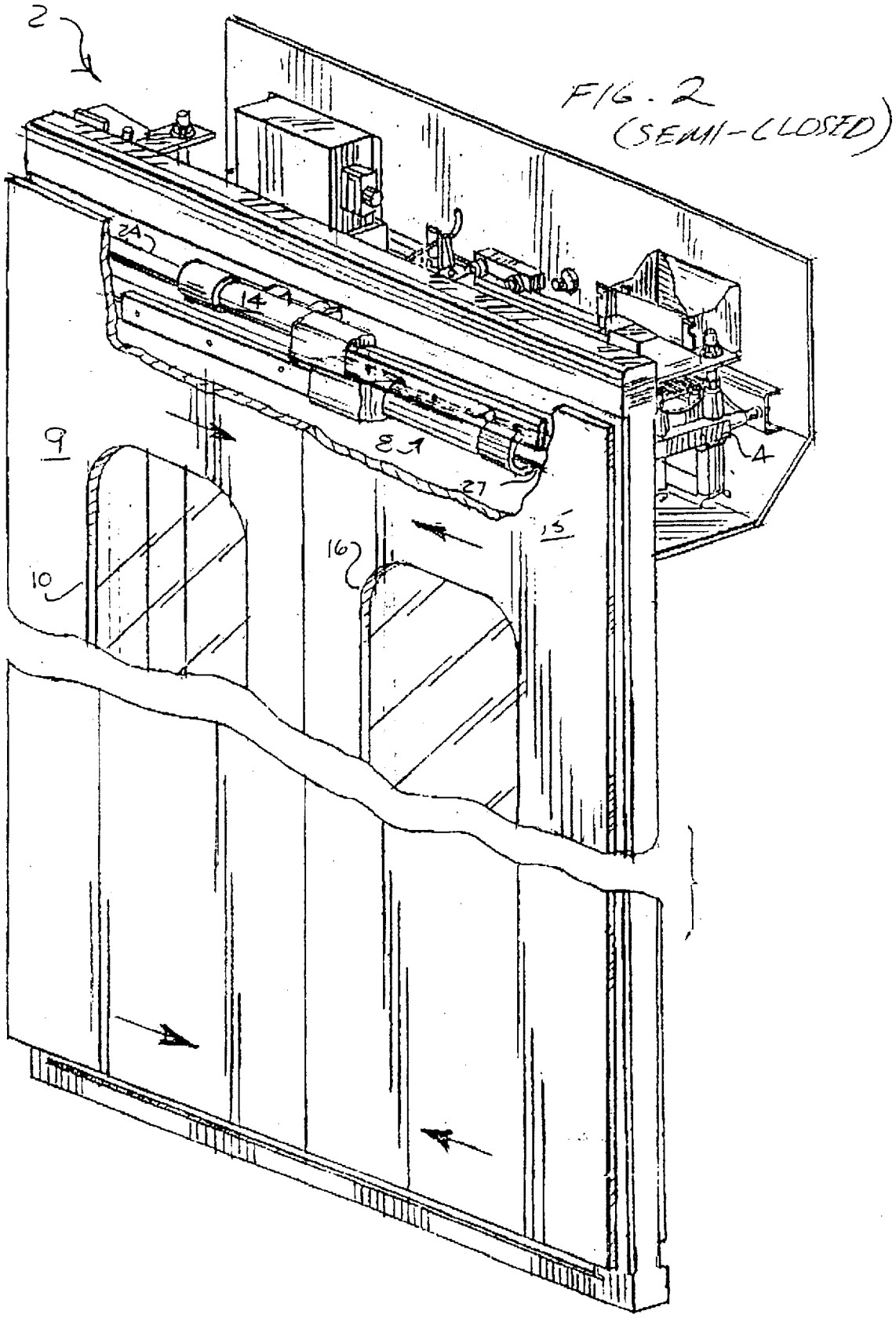
FIG. 2 shows the operator of the invention wherein the plug door operator has moved the door panels into a fully closed, unplugged position, showing position of panel hangers.
Figure 3:
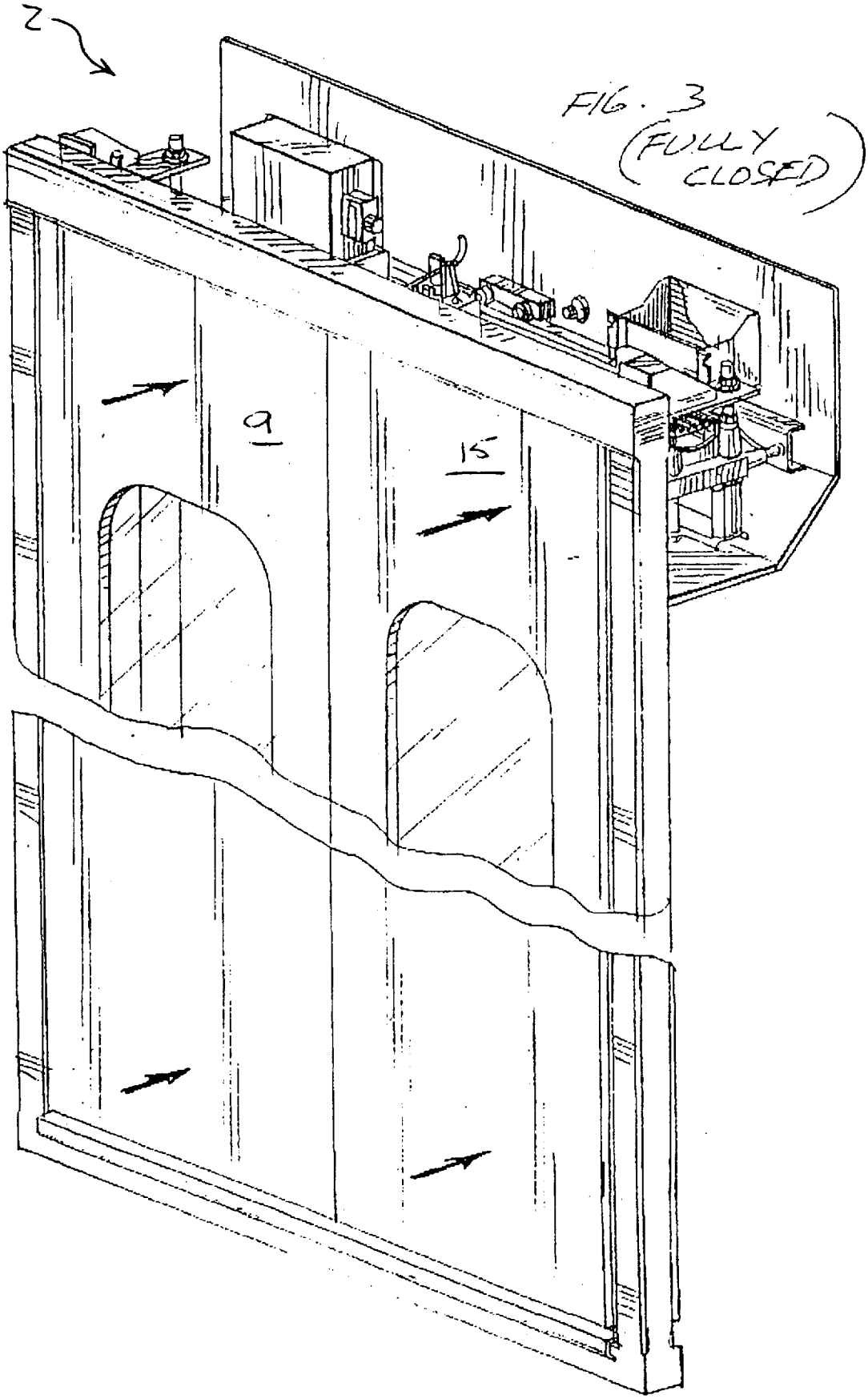
FIG. 3 shows the operator of the invention wherein the door panels are in a fully closed and plugged position inside a pocket in a car side wall.
Figure 4:
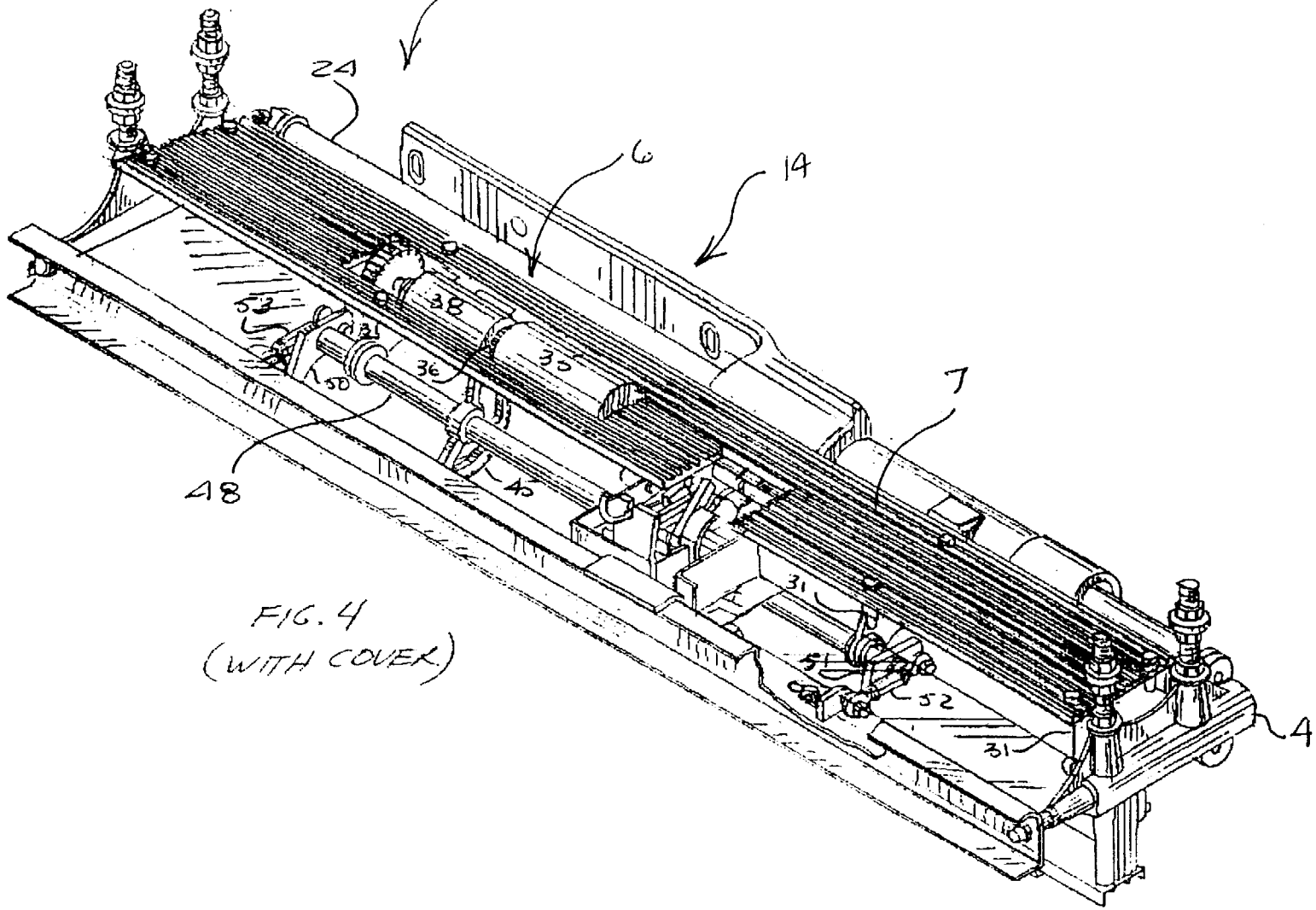
FIG. 4 shows a partial view of the operator of the invention from a view vantage opposite to FIGS. 1 and 2, particularly showing the operator to car body mounting the plug/unplug carriage and the carriage cover showing attached plug/unplug shaft brackets.

With reference to FIGS. 1, 2 and 3, there is shown the operator assembly 2 of the invention disclosed herein mounted on base plate 4 overhead of pocket opening 5 in a car body (not shown). As shown, bi-parting door panels 9 and 15 having apertures or windows 10 and 16 are driven over and away from a door opening 5. The panels are mounted on door hangers 8 and 14 operating on door slides 27 and 24, respectively, for lateral motion there along. The door hangers 14 and 8 are driven for bi-parting motion of door panels 9 and 15 along door slides 24 and 27 by helical drive members 20 and 21. Door slides 24 and 27 are mounted on carriage assembly 6. Carriage assembly 6 is mounted on base plate 4 for limited transverse movement, i.e., in and out of door opening 5, on door base plate tracks 29 located at either end of base plate assembly 4. To facilitate this transverse movement, carriage assembly 6 includes at either end cooperating track and rollers 30 (reference FIGS. 9 and 11).

The door opener carriage assembly 6 includes a carriage cover and support member 7 cooperating with a plurality of associated support brackets 31 for mounting and positioning operating elements as described below. Means for guiding the lower edges of door panels 9 and 15 are provided by bottom track 3.

With particular reference to FIGS. 4, 5, 8 and 9, the carriage assembly 6 further includes upper and lower helical drive members 20 and 21 journaled for rotary motion on support brackets 31. Also mounted on carriage assembly 6 at end plates 11 (reference FIG. 11) are upper and lower door slides 24 and 27.

Also mounted on carriage assembly 6 is drive motor 35 and planetary gear drive assembly 38. The output shaft gear 39 of planetary gear drive assembly 38 (reference FIG. 10) cooperates with pinion gears 40 and 41 to provide rotary motion of helical drive members 20 and 21. Intermediate drive motor 35 and planetary gear drive 38 is a planetary output gear 36. Gear 36 cooperatingly drives sector gear 45 attached to plug/unplug shaft 48 (reference FIG. 6).

Plug/unplug shaft 48 is journaled on support brackets 31 for rotary motion and at each end has plug/unplug levers 51 and 50 at either end of plug/unplug shaft 48. Plug/unplug levers 50 and 51 are linked to the base plate 4 by carriage base plate links 52 and 53, respectively. Links 52 and 53 are suitably attached to the base plate 50 as shown. Links 52 and 53 have operative ends. As applied, the rod ends have spherical journaling providing limited degrees of link motion relative to the link end attachment, thereby greatly simplifying proper adjustment of the plug/unplug motion.

Figures 5, 6, 6A:
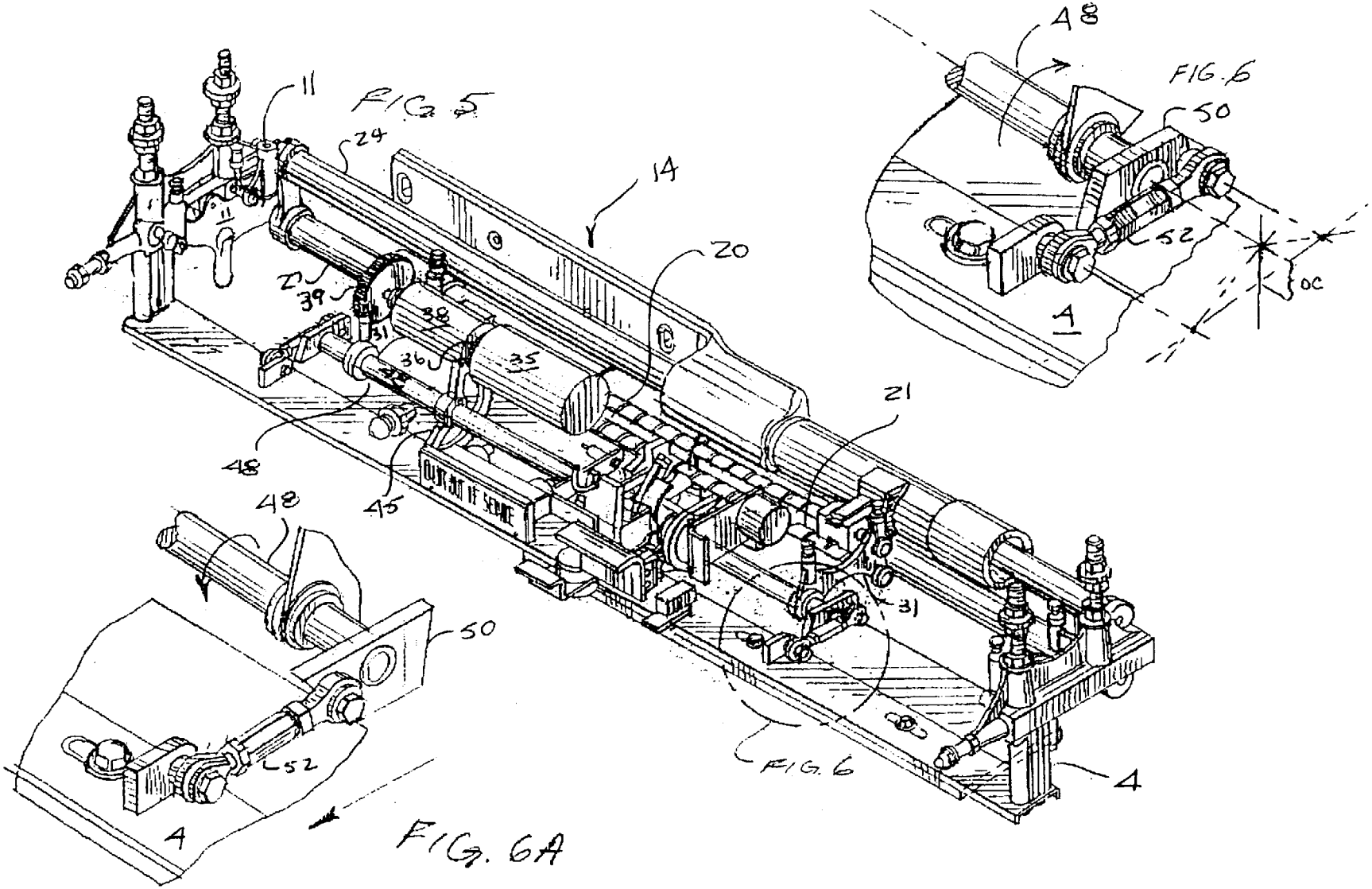
FIG. 5 is an additional partial view of the operator of the invention having the cover plate removed, thereby providing an improved view of the operating components, particularly showing the carriage/base plate slides.
FIG. 6 is a partial tearaway view of the operator of FIG. 5, particularly showing the plug/unplug shaft and linkage configuration with the carriage and base plate locked by over-center linkage position.
FIG. 6A is an additional view of the plug/unplug linkage arrangement of FIG. 5, more particularly showing the base/carriage in an unlocked condition.

In particular reference to FIGS. 6 and 6A, the combination of lever 50 and link 52 as designed, provides an over-center lock for the carriage assembly 6 when plug shaft 48 has rotated plug/unplug 50 to its fully clockwise position as shown.

Figures 9, 10:
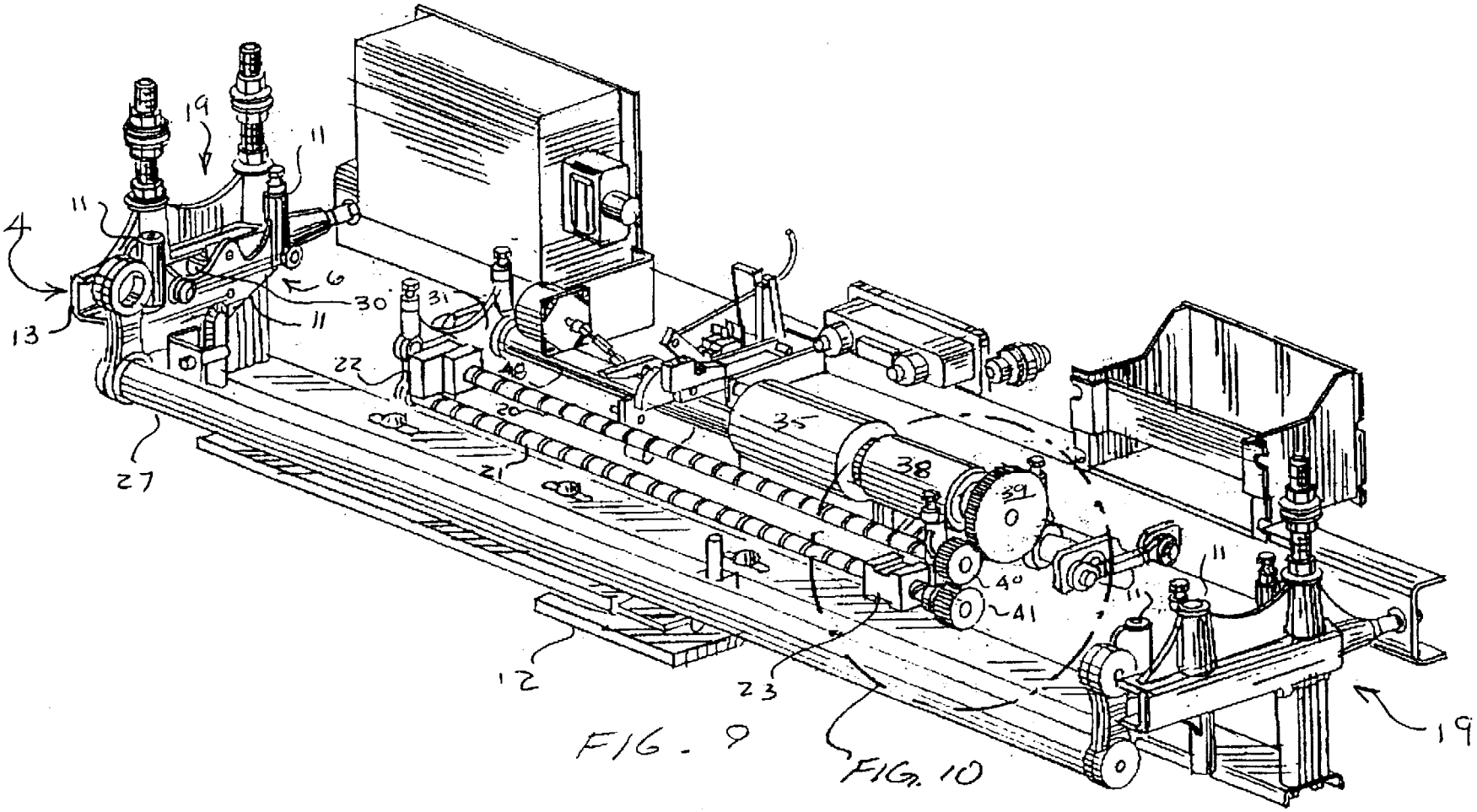
FIG. 9 is an additional partial view of the operator of the invention from the external vantage point, particularly showing the plug/unplug and helical gear drive components.
FIG. 10 is a partial tearaway of the operator of FIG. 9 showing the helical drive member gearing in greater detail.
Figure 10:
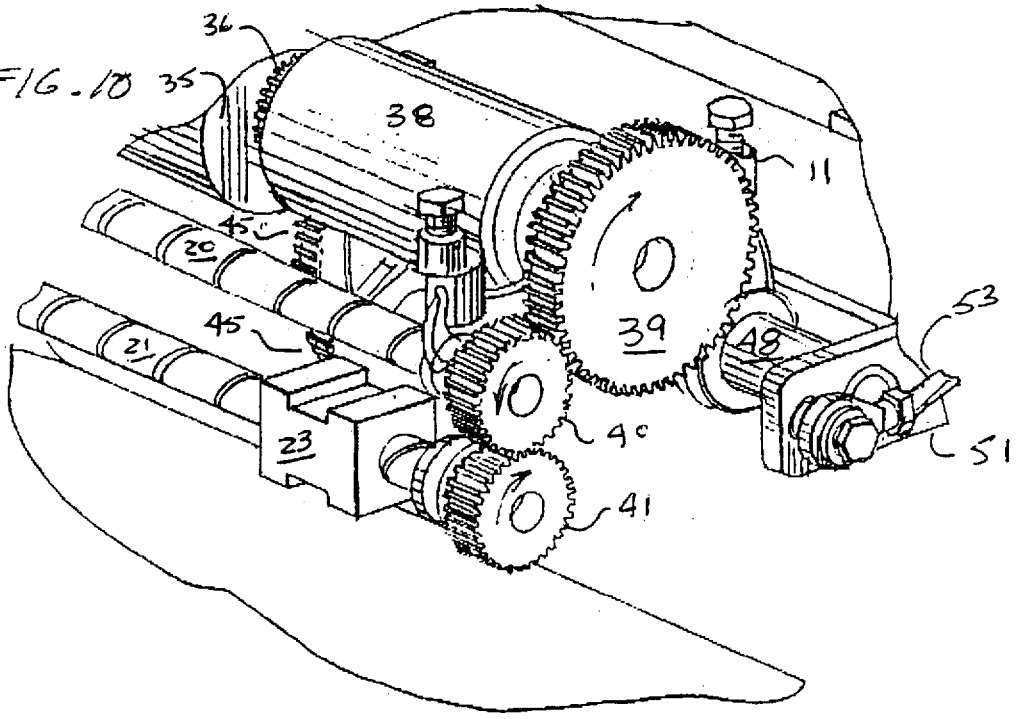
Figure 11:
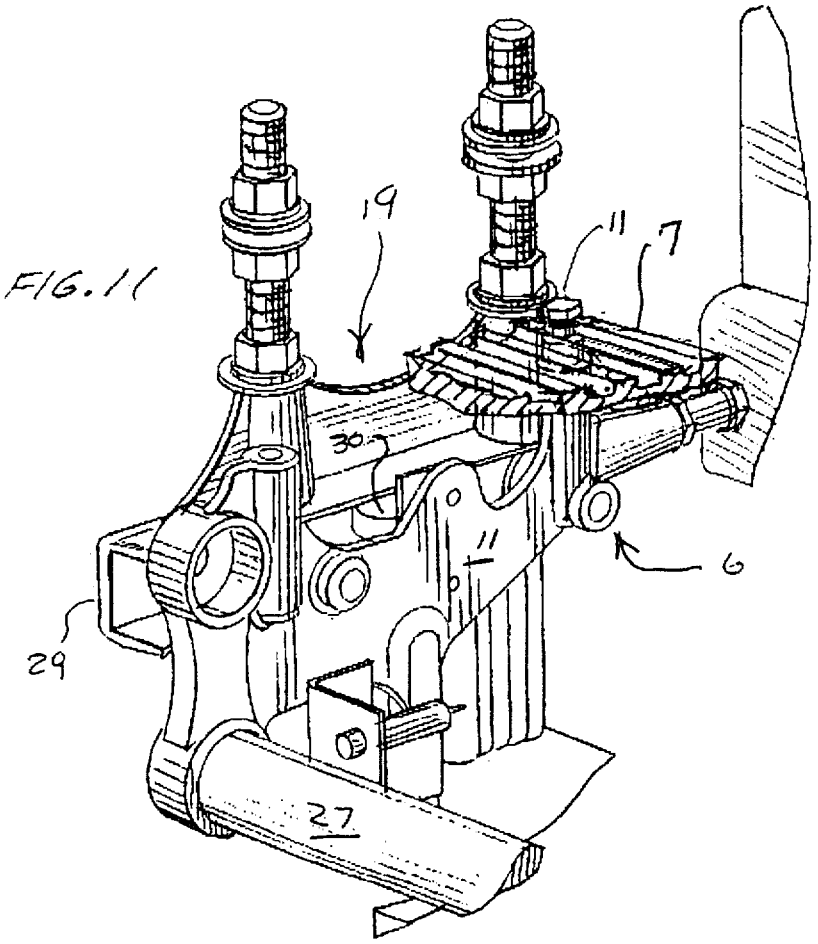
FIG. 11 is a partial tearaway view of the operator of FIG. 9, particularly showing the carriage-base plate plug/unplug tracks and cover mounting brackets.

Reciprocal motion of door panels 15 and 9 is obtained through counter-rotation of helical drive members 20 and 21 by gears 39, 40 and 41 and associated door panel movement by attachment of hangers 8 and 14 to drive nuts 22 and 23 (reference FIG. 9).

Figures 7, 8:
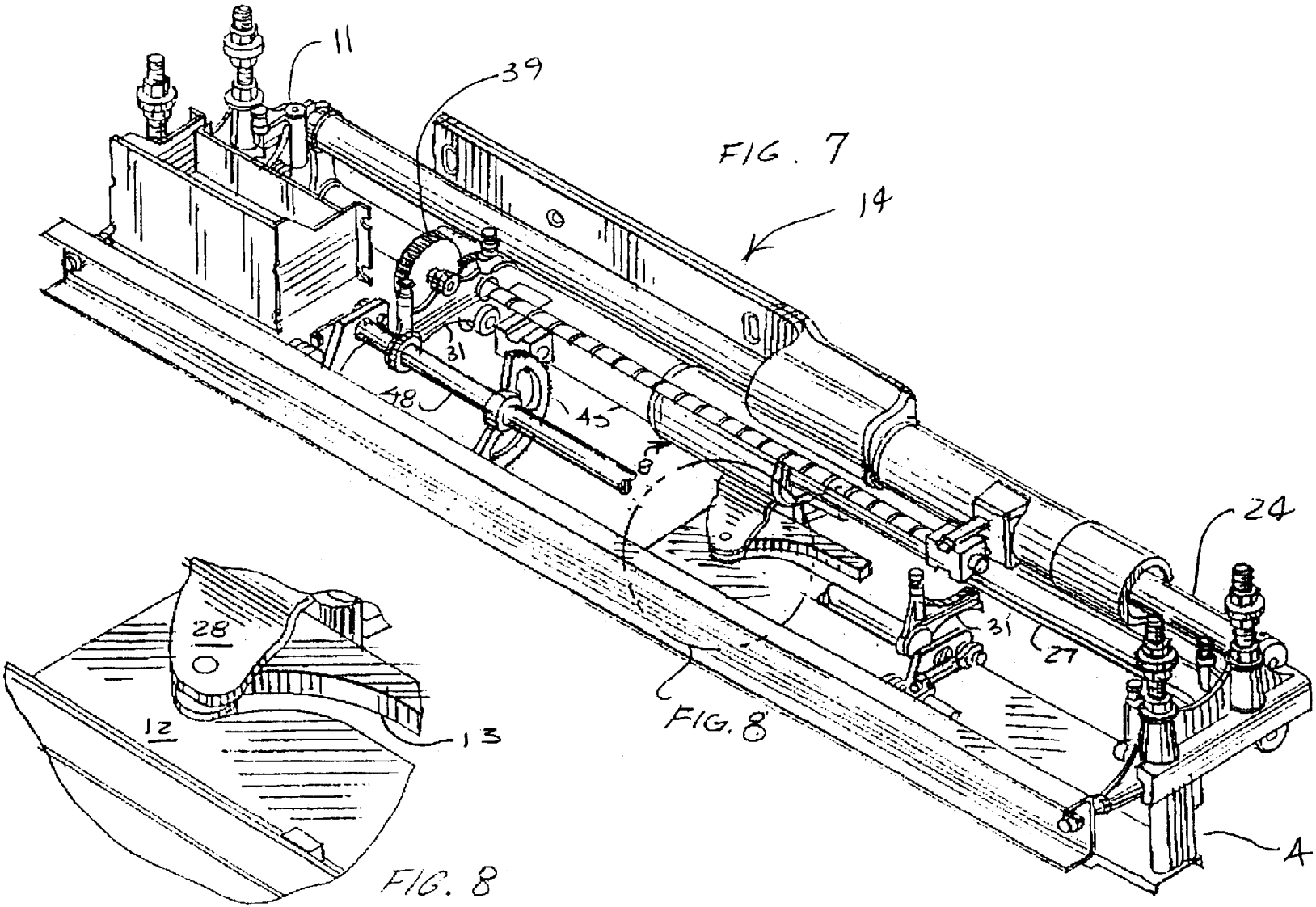
FIG. 7 is an additional partial view of the operator of the invention, particularly showing the plug/unplug link, gears, and plug/unplug track.
FIG. 8 is an partial tearaway view of the operator of FIG. 7, particularly showing curved track-door hanger connection.

Also attached to the drive nut 23 (reference FIGS. 7 and 8), is a roller cam arm 28 cooperatively engaged with groove 13 of base plate plug track 12 for guiding carriage assembly 6 into and out of a fully closed and plugged position (reference FIGS. 7 and 8).

Movement of arm 28 in the cam surface 13 of plug track 12 provides transverse movement of the carriage assembly when door panels 9 and 15, after full closing, move into a closed and plugged position.

In operation, from a configuration as shown in FIG. 1, with the door panels in a fully opened position, energization of drive motor 35 rotates gears 39, 40 and 41 in the directions shown in FIG. 10. Rotation of gears 40 and 41 correspondingly rotate helical drive members 20 and 21, thereby moving drive nuts 22 and 23 from a position at the extreme end of drive members 20 and 21 (reference FIG. 9) to opposite ends of drive members 20 and 21. Movement of drive nuts 22 and 23, attached to door hangers 14 and 8, respectively, have now moved door panels 9 and 15 into a fully closed, but unplugged position, as shown in FIG. 2, roller cam 28 affixed to hanger 8 has approached the initial portion of groove 13 of base plate plug track 12. Upon further rotation of drive motor 35 the higher torque encountered due to the fully closed position of door panels 9 and 15 and movement of roller cam 28 in groove 13 of track 12 results in rotation of planetary drive output gear 36, thereby rotating sector gear 45. Rotation of sector gear 45 rotates plug/unplug shaft 48, thereupon plug/unplug levers 50 and 51 and acting through links 53 and 52 move the entire plug/unplug carriage assembly 6 guided by base plate track 12 into the door pocket of opening 5 in the car side wall, thereby completing the plugging operation.

Upon reverse rotation of drive motor 35, door opening proceeds in an identical manner.

It should be noted that movement of the carriage assembly into a fully plugged position incorporates an over-center lock of shaft 48 by rotation of shaft 48, thereby moving plug/unplug links 52, 53 from an unlocked position shown in FIG. 6A to a locked position shown in FIG. 6. Although FIGS. 6/6A show link 52, link 53, which is attached to the opposite end of plug/unplug shaft 45, operates identically.

Thus, it is apparent that there has been provided in accordance with the power operated plug door operator disclosed herein an operator that fully satisfies the objects and advantages as set forth above. While the operator disclosed has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

Therefore we claim:

1. A plug door operator for opening and closing a pocket opening in a side wall of a transit vehicle, said plug door operator being for moving bi-parting door panels from an open position to a closed position over said pocket opening, said plug door operator comprising:

a base for mounting said plug door operator overhead in said pocket opening;

a carriage attached to said base for moving said panels into and out of said pocket opening;

said carriage including:

door slides and door hangers for attachment of said bi-parting door panels;

first and second helical drives connected to said door hangers;

a drive motor for powering said helical drives for reciprocal movement to move said door panels over and away from said pocket opening;

a planetary gear drive driven by said motor, said planetary gear drive having a planetary output gear;

a plug shaft journaled on said carriage, said plug shaft having gear means cooperating with said planetary output gear to be driven thereby;

a linkage means having connection to said plug shaft to be driven thereby, said linkage means connected to said base to move said carriage into and out of said pocket opening for plugging and unplugging said pocket opening, wherein energizing said motor with said door panels in said closed position rotates said planetary output gear, thereby moving said carriage into said pocket opening; and means intermediate said carriage and said base for locking said panels in said pocket opening when said door panels are closed and in said pocket opening.

2. The operator of claim 1 wherein said carriage further includes means for guiding a lower edge of each of said panels when said panels are in an unplugged condition and moving said panels over and away from said pocket opening.

3. The operator of claim 1 wherein said linkage means further comprises:

a lever on each end of said plug shaft;

for each of said levers an adjustable link connected to said base, said levers and links configured to prevent carriage movement from said pocket opening.

4. The operator of claim 1 wherein said motor is an electric motor.

5. A power door operator for moving bi-parting passenger door panels away and over and into and out of a pocket opening in a side wall of a mass transit vehicle comprising:

a base for mounting on said side wall, said base being for positioning overhead of and across said pocket opening in said side wall;

a carriage mounted on said base for powered movement into and out of said pocket opening, said carriage further comprising:

upper and lower helical drives journaled for rotary motion and mounted on said carriage, said helical drives each having a drive gear at one end;

drive nuts running on said helical drives;

upper and lower door slides on said carriage and adjacent said helical drives;

door hangers mounted on said door slides for movement across said pocket opening, said door hangers being for attachment of said door panels;

an electrical drive motor on said carriage having a motor output shaft;

a planetary gear drive driven by said motor output shaft, said planetary gear drive having a planetary output gear and a planetary output shaft;

a drive gear on said planetary output shaft, said drive gear coacting with each said drive gear on said helical drives for selective rotation of each said helical drive;

a plug shaft journaled for rotary motion on said carriage, said plug shaft having plug/unplug levers on each end;

for each plug/unplug lever, a link connecting said plug/unplug lever to said base;

a sector gear on said plug shaft, said sector gear and planetary output gear coacting to rotate said plug shaft, thereby turning said plug/unplug levers and moving said carriage into and out of said pocket on rotation of said planetary output gear;

means energizing said drive motor, thereby rotating said motor output shaft;

wherein drive motor rotation rotates said planetary gear drive, and helical drives, thereby moving said panels to a closed position over said pocket opening, and subsequent rotation of said planetary output gear rotates said plug shaft, thereby moving said closed door panels into said pocket opening.

6. The operator of claim 5 further comprising:

means configuring said plug shaft, said plug/unplug levers and links for retaining said carriage in said pocket opening.

7. The operator of claim 6 wherein said configuring means is an over-center lock.

8. A power door system for covering and uncovering a pocket opening in a side wall of a mass transit vehicle comprising:

a pair of biparting door panels;

a base for mounting on said side wall, said base for positioning overhead of and across said pocket opening in said side wall;

a carriage mounted on said base for powered movement into and out of said pocket opening, said carriage further comprising:

upper and lower helical drives journaled for rotary motion and mounted on said carriage, said members each having a drive gear at one end;

drive nuts running on said helical drives;

upper and lower door slides on said carriage and adjacent said drive members;

door hangers mounted on said door slides for movement across said pocket opening, said door hangers connected to said drive nuts, said door panels attached to said door hangers;

an electrical drive motor on said carriage having a motor output shaft;

a planetary gear drive driven by said motor output shaft, said planetary gear drive having a planetary output gear and a planetary output shaft;

a drive gear on said planetary output shaft, said drive gear coacting with each said drive gear on said helical drives for selective rotation of each said helical drive;

a plug shaft journaled for rotary motion on said carriage, said plug shaft having plug/unplug levers on each end;

for each plug/unplug lever, a link connecting said plug/unplug lever to said base;

a sector gear on said plug shaft, said sector gear and planetary output gear coacting to rotate said plug shaft, thereby turning said plug/unplug levers and moving said carriage into and out of said pocket on rotation of said planetary output gear;

means energizing said drive motor, thereby rotating said motor output shaft;

wherein drive motor rotation rotates said planetary gear drive, and helical drives, thereby moving said panels to a closed position over said pocket opening, and subsequent rotation of said planetary output gear rotates said plug shaft, thereby moving said closed door panels into said pocket opening.

* * * * *